United States Patent [19]

Gollon

[11] Patent Number: 4,856,819

[45] Date of Patent: Aug. 15, 1989

[54] TAG

[76] Inventor: Peter J. Gollon, 15 Eleanor Pl., Huntington, N.Y. 11743

[21] Appl. No.: 257,796

[22] Filed: Oct. 14, 1988

Related U.S. Application Data

[63] Continuation-in-part of Ser. No. 120,013, Nov. 13, 1987.

[51] Int. Cl.[4] ..... B42D 15/00

[52] U.S. Cl. ..... 283/79; 263/81

[58] Field of Search ..... 283/79, 81

[56] References Cited

U.S. PATENT DOCUMENTS

| | | | |
|---|---|---|---|
| 3,994,085 | 11/1976 | Groselak et al. | 283/81 X |
| 4,372,681 | 2/1983 | Sallenbach | 356/72 |
| 4,519,631 | 5/1985 | Stone et al. | 283/70 |
| 4,577,426 | 5/1986 | Jenkins | 40/21 R |
| 4,631,845 | 12/1986 | Samuel et al. | 40/2 R |

FOREIGN PATENT DOCUMENTS

| | | |
|---|---|---|
| 1368355 | 3/1964 | France . |

*Primary Examiner*—Paul A. Bell

*Attorney, Agent, or Firm*—Ladas & Parry

[57] ABSTRACT

A tag has first second and third planar segments, each segment having opposite, front and back planar surfaces bounded by at least one edge extending between the planar surfaces. Two, flexible, segment connectors respectively connect portions of the edges of the first and second and second and third segments in a manner such that at least the front surfaces of the segments are in a common plane when the segment connectors are not flexed. The front surfaces of the segments can be printed, therefore, in a one-sided printing operation. When the segment connectors are flexed by folding, the front surfaces of the first and second segments are juxtaposed and one of the surfaces of the third segment is juxtaposed with the back surface of one of the first and second segments. This covers the printing on the front surfaces of the first and second segments, until the segment connector therebetween is unfolded to expose it. The tag is attached to an item, by adhesive on the back surface of one of the segments, or by a strap forming one of the segment connectors, or by a tail projecting form one of the segments.

6 Claims, 5 Drawing Sheets

TAG

This application is a CIP of 07/120.013 filed Nov. 13, 1987.

BACKGROUND OF THE INVENTION

The invention relates to a tag.

Tags have long been attached to items to identify their prices. Today, however, more information than just the price of a product, or even instead of the price, is frequently desired on the tag. For example, product quality, content, care or inventory control code, such as a bar code for point-of-sale inventory and accounting control, may be desired. As used herein, tag denotes a tag for receiving in any way, hereinafter called printing, any information to be attached to an article for any reason. One example is a baggage destination and/or identification tag used by airlines for checked baggage.

One known type of tag is an adhesive label, i.e. a piece of paper or similar material, printed with the price or other information on one side, and coated with an adhesive on the opposite side. The adhesive is used for adhering the tag to a product. This type of tag has wide acceptance, but the amount of information that can be printed on the tag is limited by the size (i.e. area) of the one printable side of the tag. Examples of this type of tag are the manufacturers' labels on food jars, or the self-adhesive price tags used in supermarkets.

Another known type of tag is a hang tag such as is usually found attached to clothing when offered for sale by retailers. This type of tag can have printed information on both sides. It can be applied to an article by a string affixed to it, or, in the case of clothing, by a plastic loop or hooking device which passes through both the tag and the clothing. This type of tag is used where it is impractical or undesirable (e.g. clothing or jewelry) to use adhesive to affix the tag to the relevant merchandise. It is also used for its ability to contain printed information on both sides, which is an advantage over an adhesive label of similar size. A hang tag may be made by printing heavy paper or card stock on both sides; it may also be made by starting with a piece of material twice as large as the finished tag, printing all information on just one side of the material, and then folding it in half so the unprinted side meets itself and the printed side is exposed top and bottom. The two unprinted surfaces may be adhered together at this point, and a string loop may be inserted between them prior to their being joined in order for the loop to be permanently affixed to the tag. The printing may also occur separately on both sides after the string loop is attached.

A variant (ring tag) of the hang tag has all the printed information on one side of the tag material, and pressure sensitive adhesive on part or all of the other side. The unassembled tag is passed either through the merchandise (e.g. a ring or belt buckle) or around a narrow part of it (e.g. a clip on a pen). It is then folded back on itself so that it is held closed by the adhesive which is now hidden, and both visible sides of the assembled tag contain printed information.

By virtue of its two available surfaces, a given finished size hang tag contains twice the imprintable area as an adhesive label of the same size. However, this construction still has two drawbacks which are most acute in the case of jewelry tags, but which still apply in other areas as well. First, even the two imprintable sides of the finished tag may not legibly accommodate all the necessary information without undesirably increasing the size of the tag. Second, all the information printed on the tag is always conspicuously visible on one side of the tag or the other. Price tags for jewelry illustrate these drawbacks well.

Regarding the first problem, it is often desired to keep jewelry price tags small to avoid overwhelming the usually small product with the size of the tag. It is often also desired, however, to have considerable information on a jewelry price tag. For example, the retailer's name, the price, the manufacturer's name and item number, the quality (e.g. 14 karat gold), precious stone content (e.g. 1.24 carat diamonds), gemstone treatment (e.g. irradiated for color enhancement), country of origin, and retailer's inventory or stock number may all be desired on the price tag or may even be required by government regulations. In addition, modern merchandising techniques may involve the placement of a bar code on each item to facilitate the rapid and accurate physical inventory counting, and pricing and recording at the time of sale. Thus there is a need to place more information on a small tag than will physically fit on it.

Regarding the second problem, it is often desired to limit the information visible on a jewelry price tag to that information which is necessary and desirable for the customer to see prior to purchase. Information such as store stock number, manufacturer's name and stock number, date of purchase by the store, and a bar code used at the time of sale need not be visible to the customer during the process of selecting merchandise. In fact, the visibility of some of these items by the customer may detract from the appeal and quality image that is desire for the merchandise itself. This may be especially true of bar codes which are used at the point of sale (cash register), and which are still associated by some with grocery-like commodities. It would be desirable, therefore, to temporarily cover some information on a jewelry tag until such time as the information is needed.

SUMMARY OF THE INVENTION

It is, therefore, an object of the invention to provide a tag having more information space for the size of the tag than heretofore available in either an adhesive label or hang tag format.

It is another object that at least some of the printable, information space of the tag be temporarily covered until the information printed thereon is needed.

These paragraphs summarize a general description of a tag meeting the above-described objects. The tag is made of a planar material having two opposite planar surfaces, hereinafter denoted front and back. All information to be carried by the finished tag may be applied to the front of the flat, unassembled tag in a one-pass, single sided printing operation. All or part of the back surface is available for adhesive (preferably pressure-sensitive) to be used to hold the tag in its assembled configuration, and possibly to affix it to the merchandise being labelled. The tag is composed of three (or more) planar segments, which are preferably approximately congruent. More than three segments may be required by the quantity of the information to be carried by the tag, or by the method chosen to attach the tag to the desired product, as will be described below.

Each segment is bounded by one or more physical edges (whether straight or curved) and one or more segment connectors. The segment connector is most commonly a straight fold line separating two adjoining segments of one piece of the tag material. However, a segment connector may also be a flexible strap or strap-like portion of the tag material. (A strap-like segment connector may also be used to encircle the merchandise, thereby attaching the tag thereto.) Thus the tag segments are continuously connected, separated either by folds between segments, or by one or more segment-connecting straps. As there are at least three segments, there must be at least two segment connectors (i.e. one between each two adjacent segments).

Thus, first, second and third planar segments each have opposite, front and back planar surfaces bounded by at least one edge extending between the planar surfaces. Two, flexible segment connectors connect a portion of the edges of the first and second and second and third segments in a manner such that the front surfaces of the segments are in a common plane when the segment connectors are not flexed. As a result, the front surfaces can be printed in a one-sided printing operation.

The tag is then made ready for use, that is, assembled by folding. In folding, the segment connectors are flexed so that the segments are superposed with one another. Each of the segment connectors (folds or straps) is thus flexed or folded in an appropriate direction, either up or down. A down fold is made to cause the back surfaces of two adjacent segments to be juxtaposed, and thus to adhere if the back of either one of them has adhesive on it. If they do adhere, they will combine to form a leaf (as in the leaf of a book). The printed information on the front of each segment so joined will be visible on one side or the other of the leaf so formed.

If a segment connector is folded up, then the front surfaces of two adjacent segments will be brought into contact. Any information printed on the area of their mutual overlap will then be hidden from view until this fold is opened. Until that time, the fold may be held closed either by the stiffness of the folded tag material itself, or by an arrangement such as (but not limited to) adhesive. At least one up fold, in which the two front (imprintable) surfaces of two segments are brought into contact, is required for this invention.

More complicated folding patterns with more segments are also possible.

When partially assembled by folding or flexing and possibly mutual adhesion of the back surfaces of two or more segments, the tag will resemble a pamphlet or folded paper of two or more leaves. The front surfaces of the various segments will be positioned to form the pages (two pages form the opposite surfaces of one leaf) on which information printed in a one sided operation may appear.

When fully assembled, the tag will be attached to merchandise by a segment-connecting strap or tail strap (later described), if either is present; and will then be folded to a compact configuration in which a number of facing pages are folded into a closed, face-to-face contact position. If the tag is to be adhered to the merchandise, then the back of one segment will remain exposed for attachment to the merchandise. With either method of attachment, the printed information on the inside pages will remain hidden from view until the tag is opened.

If the assembled tag is adhesively attached to the merchandise, then the adhesive pattern on the back and the sequence and direction of folds will leave an adhesive-bearing back surface exposed for such purpose.

If the assembled tag is attached by a strap-type segment connector, this is accomplished by looping the strap through the merchandise to be labelled prior to completing the folding and closing process.

An alternative method of affixing the tag to the merchandise may be used to provide greater versatility than, but similar results to that provided by the segment-connecting strap. In this method, a thin strap or tail of tag material projects from an edge of a tag segment. This tail is used to encircle or pass through the product being tagged, just as the segment-connecting strap did. It then has its end adhered to the adhesive on the back of one of the tag segments. There are two advantages to using a tail rather than a segment connecting strap for attachment to merchandise: first, the tail will pass through small openings (e.g. a small link in a jewelry chain) that a tag segment cannot; and second, the tail may be shortened to any appropriate length prior to the assembly of the tag, whereas the length of a segment connecting strap is fixed when the tag is manufactured.

The description in this paragraph of the invented tag in its simplest preferred embodiment is included merely as an aid to understanding the nature of the invention, and is not intended to limit in any way the scope of the claims being made. In its simplest form the tag consists of a piece of initially planar material having three planar segments of approximately equal size, each segment being separated (delimited) from the adjacent segment(s) by a fold (segment connector) of the material. One, front side of the material is printed. Adhesive is applied to all or part of the opposite, back side. The finished tag is folded in a zig-zag fashion, so that the printed sides of two adjacent segments face each other, so as to be hidden from view, and the third segment is folded thereover. The adhesive on the backs of two segments whose backs then meet serves to adhere them together, so their printed sides then appear to be opposite sides of a single piece of the material of twice the original thickness. The back of the third segment then may be attached to an item (e.g. merchandise) by its still exposed adhesive, thus affixing the entire tag to the item. As described so far, the two, adhered segments may be freely lifted like the cover of a book, pivoting about the fold separating the second and third segments. Should it be desired to prevent this, a small amount of adhesive may be used to hold the cover closed until it needs to be opened.

This embodiment thus accomplishes both objects described above, namely the ability to print more information on its three segments than will legibly fit on a conventional tag of the same (finished) size, and the ability to have some of that information hidden from view on its facing sides until it is desired to see it. A similarly designed tag with four or more segments is also possible.

BRIEF DESCRIPTION OF THE DRAWING

Merely preferred embodiments, which illustrate but do not limit the invention, will now be described with reference to a drawing, in which.

DESCRIPTION OF THE PREFERRED EMBODIMENTS

Figure 1:
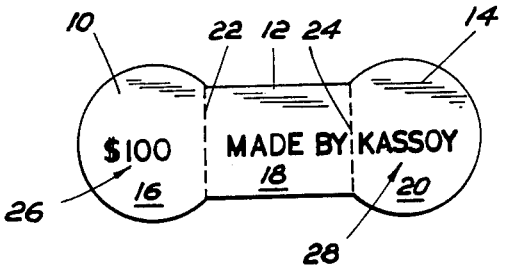
FIG. 1 is an enlarged plan view of a first preferred embodiment in an unfolded, printable condition.
Figure 2:
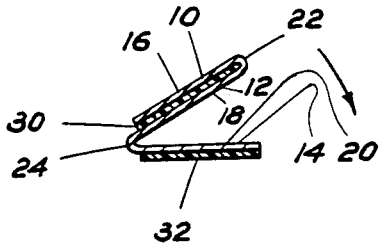
FIG. 2 is an enlarged rear, sectional elevation of the embodiment of FIG. 1 in a substantially folded or assembled condition.

The preferred embodiment of FIGS. 1 and 2 has first, second and third planar segments 10, 12 and 14. The segments have front planar surfaces 16, 18, 20, respectively, and opposite, back planar surfaces (FIG. 2) bounded by edges between the planar surfaces. Two flexible segment connectors 22, 24 respectively connect portions of the edges of the first and second and second and third segments. In this embodiment, the segments and segment connectors are portions of a single sheet of material, and the segment connectors are just fold lines across the segments.

When the segment connectors are not flexed or folded, they arrange the front and back surfaces of the segments in a common plane. This permits the front surfaces of the segments to be printed in a single, one-sided printing operation with information such as a price ($100.00) at 26 on the front surface 16 and the name of a manufacturer (Made by Kassoy) at 28 on the front surfaces 18 and 20. The fold-line structure of the segment connector 24 permits the printing to cross the segment connectors as shown for segment connector 24 by the printing at 28.

As shown in FIG. 2, the segment connector 24 can then be folded up by flexing to juxtapose the front surfaces 18, 20 of the second and third segments when the folding is completed in the direction of the arrow. The segment connector 22 is oppositely flexed down to fold the back surfaces of the first and second segments 10, 12 into juxtaposition. In this regard, it is noted that the various segments are denominated first, second and third in an arbitrary manner, merely to distinguish them, and not to limit them to a particular order, or in other ways.

The back surface of at least one of the first and second segments 10, 12 is coated with an adhesive 30. The adhesive therefore holds these segments closed when they are juxtaposed as shown in FIG. 2. The second and third segments 12, 14 could be held closed when juxtaposed by the stiffness of the segment connector 24, but preferably, the adhesive is on the back surface of the first segment 10, and the first and third segments 10, 14 are wider (vertically in FIG. 1) than the second segment 12. This permits the adhesive to adhere the wider margins of the first and third segments together, too, to hold the tag closed until opened to reveal the name of the manufacturer printed thereon at 28 (FIG. 1), when desired.

The back surface of the third segment 14 is coated with an adhesive 32. The adhesive 32 can then be used to attach the now-assembled tag to merchandise. With the segments of the tag fully juxtaposed, therefore, only the price at 26 is displayed. Flexing the segment connector 24 to separate the second and third segments 12, 14, however, can still reveal the name of the manufacturer at 28, when desired, even while the tag is attached to the merchandise.

Figure 3:
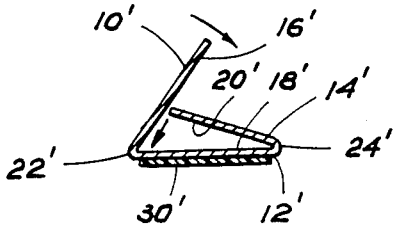
FIG. 3 is an enlarged front, sectional elevation of a second preferred embodiment in a substantially folded or assembled condition.

FIG. 3 shows an embodiment similar to that of FIGS. 1 and 2, but with the segment connector 22′ flexed by folding in the opposite way. As a result, the front surfaces 18′, 20′ of the second and third segments will be juxtaposed when the segment connector 24′ is fully flexed by folding, but the front surface 16′ of the first segment will be juxtaposed with the back surface of the third segment when the segment connector 22′ is fully flexed by folding. In this embodiment, therefore, none of the printed, front surfaces are visible when the assembled tag is adhered to merchandise with adhesive 30′ on the back surface of the second segment 12′, but all of it can be revealed by unfolding the segment connectors.

Figure 4:
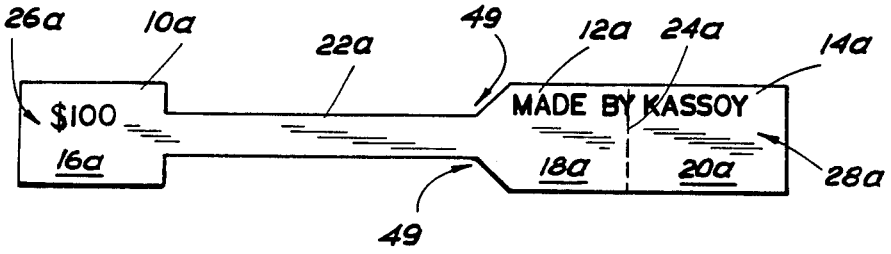
FIG. 4 is an enlarged plan view of a third preferred embodiment in an unfolded, printable condition.
Figure 5:
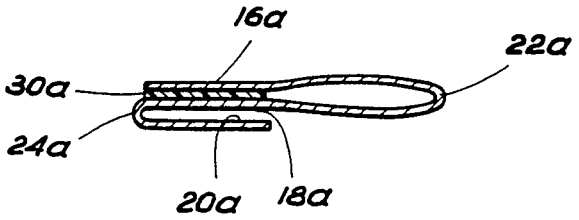
FIG. 5 is an enlarged rear, sectional elevation of the embodiment of FIG. 4 in a folded or assembled condition.

The embodiment shown in FIGS. 4 and 5 is similar to those of FIGS. 1 to 2, with correspondingly-identified components, except for the segment connector 22*a*. The segment connector 22*a* is a strap of the material of the segments extending between portions of the edges of the first and second segments 10*a*, 12*a*. The segments 10*a*, 12*a*, and 14*a* are also approximately congruent, except for cut corners at 49 on the second segment.

As shown in FIG. 5, when the segment connector 24*a* is folded by flexing, the front surfaces 18*a*, 20*a* of the second and third segments are juxtaposed. Flexing the strap segment connector 22*a* by folding juxtaposes back surfaces of the first and second segments 10*a* , 12*a*. Adhesive 30*a* on the back surface of one of at least one of the first and second segments holds their back surfaces together, thereby keeping the segment connector 22*a* closed.

The strap segment connector therefore forms a loop closed by the adhesive 30*a* between the first and second segments. The loop can be closed, therefore, around a portion of a product. For example, the first segment 10*a* could be slipped through a ring before being adhered to the second segment 12*a*. As before, the stiffness of the segment connector 24*a* could keep the front surfaces of the second and third segments juxtaposed to hide the printing thereon, until desired, but adhesive 30*a* on the back surface of the first segment 10*a* will adhere to the front surface 20*a* of the third segment at the cut corners at 49 to do this better.

Figure 6:
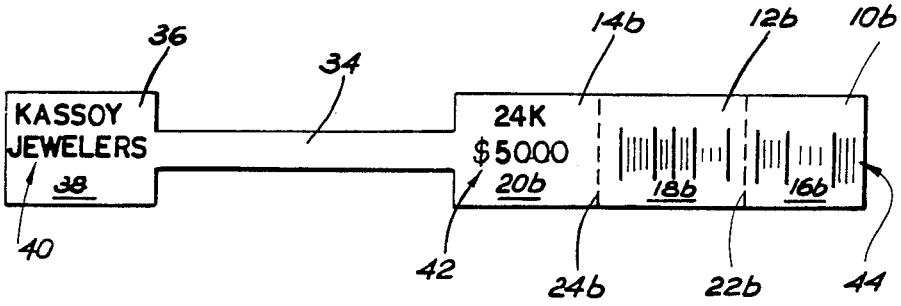
FIG. 6 is an enlarged plan view of a fourth preferred embodiment in an unfolded, printable condition.
Figure 7:
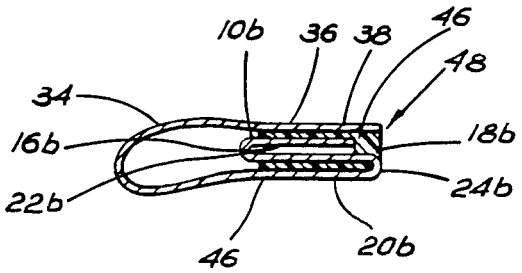
FIG. 7 is an enlarged rear sectional elevation of the of FIG. 6 in a folded or assembled condition.

The embodiment of FIGS. 6 and 7 is similar to those already described in sheet-material first, second and third segments 10*b*, 12*b* and 14*b* and fold-line segment connectors 22b and 24b. However, one end of a strap 34 of the sheet material projects from the edge of the third segment 14b opposite the segment connector 24b connecting the segment 14b to the segment 12b. Another segment 36 is formed by the material at the opposite end of the strap 34 which, therefore, forms another segment connector. The segment 36 has a front planar surface 38 and an opposite, back planar surface bounded by edges therebetween.

The segment connectors arrange the front surfaces of the segments in a common plane for printing in a single, one-sided printing operation. For example, a vendor's name may be printed, as at 40, on the front surface of the fourth segment 36, quality and price information may be printed, as at 42, on the front surface of the third segment 14b and a bar code may be printed, as at 44, on the front surfaces of the first and second segments 10b, 12b. The fold line segment connector 22b is important for the bar code to permit accurate placement of the bars of the code across both of the first and second segments, whereby the size of the tag may be reduced while still accommodating a full bar code.

For assembly, as shown in FIG. 7, the segment connector 22b is flexed for folding the front surfaces 16b, 18b of the first and second segments into juxtaposition. The segment connector 24b is flexed to fold the back surfaces of the second and third segments into juxtaposition. The segment connector 34 is flexed to fold the back surfaces of the first and fourth segments 10b, 36 into juxtaposition. Adhesive 46 on the back surfaces of the segments then adheres the back surfaces together. This assembles the tag and holds the strap 34 in a loop, which may extend through a portion of a product, for attaching the tag to the product, as with the embodiment of FIG. 5.

The second, third and fourth segments 12b, 14b and 36 are congruent, but the first segment 10b is only similar. It is shorter in the axial direction of the segments and strap. As a result, a portion of the adhesive 46 on the back surface of the fourth segment 36 adheres to the front surface 18b of the second segment at 48 when the tag is assembled. This keeps the bar code at 44 hidden inside the tag until exposed by parting the adhesive at 48, for example, and unfolding the segment connector 22b.

Figure 8:
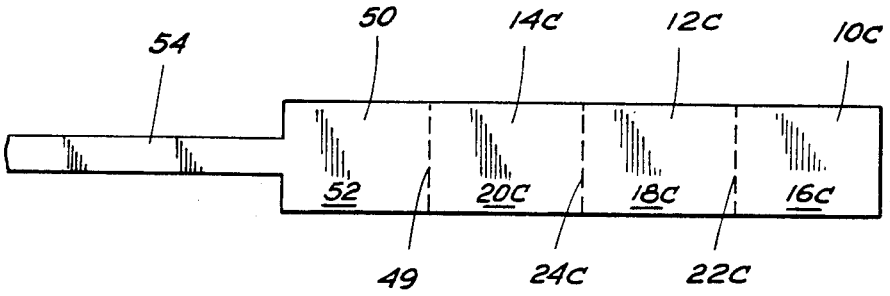
FIG. 8 is an enlarged plan view of a fifth preferred embodiment in an unfolded, printable condition.
Figure 9:
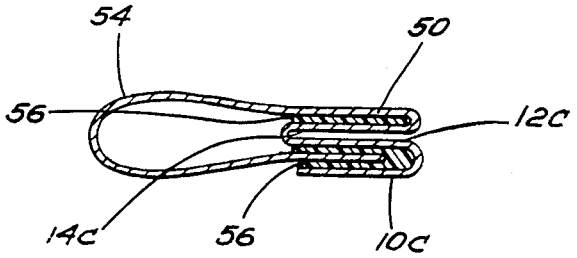
FIG. 9 is an enlarged front, sectional elevation of the embodiment of FIG. 8 in a folded or assembled condition.

The embodiment of FIGS. 8 and 9 is similar to those of FIGS. 3 to 7, except that another fold-line segment connector 49 extends the sheet material to another in-line segment 50. As with the other segments, the segment 50 has a planar front surface, an opposite, planar back surface, and bounding edges, for disposing the segments in a common plane, for printing (not shown), when the segment connectors are not flexed.

A particular kind of strap, a tail strap 54 of the sheet material, projects from one end on an edge of the segment 50 opposite the segment connector 49 to an opposite, free end of the tail. The segment connectors are then folded, as shown in FIG. 9, to juxtapose the back surfaces of the first and second and third and fourth segments 10c, 12c and 14c, 50 for attachment by adhesive 56 thereon. Before the back surfaces of the first and second segments 10c, 12c are adhered, however, the free end of the tail is placed therebetween, to close the tail in a product-attachment loop. The size of the loop can be adjusted by cutting the length of the tail appropriately.

Figure 10:
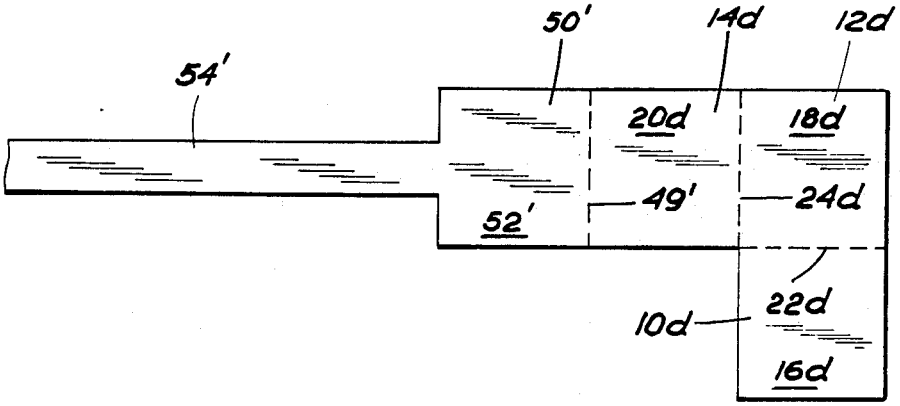
FIG. 10 is an enlarged plan view of a sixth preferred embodiment in an unfolded, printable condition.
Figure 11:
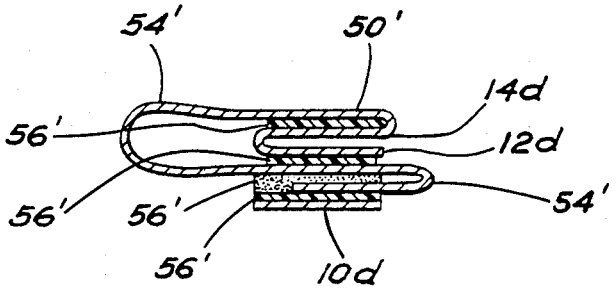
FIG. 11 is an enlarged front, sectional elevation of the embodiment of FIG. 10 in a folded or assembled condition.

The embodiment of FIGS. 10 and 11 is particularly similar to the embodiment of FIGS. 8 and 9, except for the arrangement of the segments. It, too, is made out of one piece of sheet material with four, congruent, planar-surfaced, rectilinear segments 10d, 12d, 14d, 50' with a narrower tail projecting to a free end from one end on an edge of segment 50'. However, the fold-line segment connector 22d between segments 10d and 12d is along edges of the segments perpendicular to the fold-line segment connectors 24d and 49' between the other segments. As a result, when the segment connectors are flexed to fold the segments into juxtaposition as shown in FIG. 11, the tail 54' can pass all the way between the segments 10d and 12d, and then double back therebetween to form two loops, one on either side of the segments. Because the tail 54' has a narrower width than the segments, as shown in FIG. 10, the adhesive 56' on the back surfaces of segments 10d and 12d adheres the segments together on the front and, as shown in FIG. 11, rear sides of the tail to hold the segments and tail together.

Figure 12:
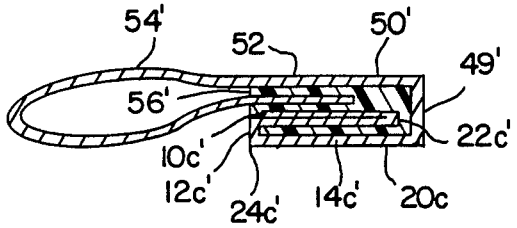
FIG. 12 is an enlarged front, sectional elevation of the embodiment of FIG. 8 in another folded or assembled condition.

The embodiment shown in FIG. 8 can also be used in a way different from that shown in FIG. 9, as now more preferred and shown in FIG. 12, wherein the same reference characters are used as in FIG. 8, with primes added thereto. To achieve the arrangement of FIG. 12 from the embodiment of FIG. 8, the tail strap 54' is first looped through a ring-like object (not shown) to attach the tag thereto. Then the segments 10c', 12c', 14c' and 50' are folded about segment connector 24c' into superposition, adhesive back to adhesive back, with the free end of the tail strap 54', originally remote from segment 50', therebetween. The adhesive 56' on the backs of the segments thus secures the tail strap 54' in its object-attaching loop. Then the superposed segments are folded about thensuperposed segment connectors 22c' and 49' simultaneously to superpose all the segments as shown in FIG. 12.

As shown in FIG. 12, it is desirable for this arrangement that the segment 10c' be axially shorter than the other, in-line segments, which are congruent. This leaves the adhesive 56' on the back of segment 12c' exposed at a margin at segment connector 24c' when the segments are superposed as shown in FIG. 12. This adheres segment 12c' to segment 50' and the tail strap 54' to hold the tag in the arrangement of FIG. 12 with the front, printed surfaces (16c, 18c in FIG. 8) of segments 10c' and 12c' juxtaposed, until the adhesive margin is separated, when desired.

This arrangement of the embodiment of FIG. 8 is now the best mode contemplated when the ring-like object is too small to pass the segments 10c', 12c', 14c' and 50' therethrough.

Figure 13:
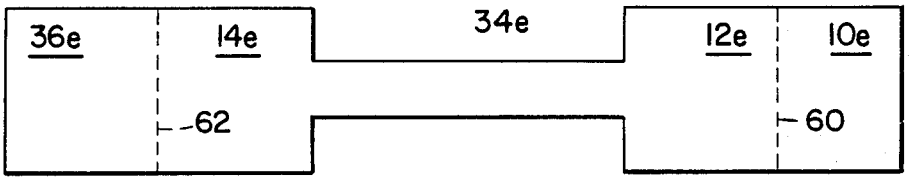
FIG. 13 is an enlarged plan view of a seventh preferred embodiment in a unfolded, printable condition.

FIG. 13 shows another embodiment, which is now particularly preferred and the best mode contemplated when a ring-like object (not shown) with which it is used is large enough to pass its segments 10e, 12e, 14e and 36e therethrough. It is particularly similar to the embodiment shown in FIG. 6, but has two in-line, successive segments 10e, 12e and 14e, 36e, respectively, at axially opposite ends of a strap 34e. The segments 10e, 12e and 14e, 36e are respectively connected to each other by fold-line segment connectors 60, 62. Segments 12e, 14e and 36e are congruent, but segment 10e is only similar, because it is slightly shorter axially than the other segments.

Figure 14:
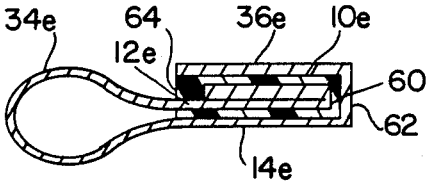
FIG. 14 is an enlarged front, sectional elevational of the embodiment of FIG. 13 in a folded or assembled condition.

This embodiment can be arranged as shown in FIG. 14 by first slipping the segments on one end of the strap 34e through a ring-like object, and then flexing the strap into a loop to superpose the segments, 10e on 36e and 12*e* on 14*e*, adhesive back to adhesive back, so that the adhesive 64 on the back surfaces of the segments holds them together to keep the loop of the strap about the object. This also superposes the foldline segment connectors 60, 62, which are then simultaneously folded to superpose all the segments, as shown in FIG. 14, with front, printed surfaces of segments 10*e*, 12*e* juxtaposed. The axially shorter length of segment 10*e* then leaves a margin of the adhesive back of segment 36*e* exposed, and this margin of adhesive 64 adheres to segment 12*e* to keep the front, printed surfaces of segments 10*e* and 12*e* juxtaposed until the margin of adhesive is separated. This embodiment and arrangement thus has the advantage over that of FIGS. 6 and 7 of being easier to assemble for use.

Figure 15:
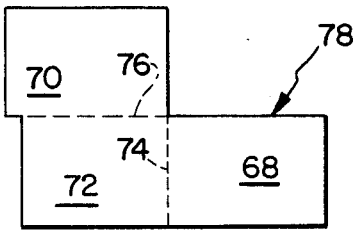
FIG. 15 is an enlarged plan view of an eigth preferred embodiment in an unfolded, printable condition.

Another embodiment which is attached to an article by adhesive is shown in FIG. 15. It is now the best mode of this type of tag.

This embodiment has two, first and second, congruent, rectangular segments 68, 70 and a third segment 72 which is only similar to the other two in rectangular shape, being slightly shorter in one dimension, left to right in FIG. 15. A first edge of the third, only similar segment 72 is connected to a mirror-corresponding edge of the first of the other two segments by a first fold-line segment connector 74, and a second, adjacent perpendicular edge of the third segment 72, which extends in the direction the third segment is shorter, is connected to a mirror corresponding edge of the second of the other two segments by a second fold-line segment connector 76.

Thus, segment connector 74 can be flexed or folded to juxtapose front, printed surfaces of the first and third segments 68, 72, except at a margin at 78 of the first segment, and segment connector 76 can be flexed to place the second and third segments 70, 72 back to adhesive back. The adhesive back of the second segment then covers the margin 78 of the first segment, too, and adheres to the front surface of the latter to keep the front printed surfaces of the first and third segments juxtaposed until wanted.

Other embodiments, as will occur to those skilled in the art, are contemplated as within the scope of the following claims.

I claim:

1. In a tag having:

at least first, second and third planar segments, each segment having opposite, front and back planar surfaces bounded by at least one edge extending between the planar surfaces, the front surfaces being for printing;

at least two, flexible, segment-connector means for respectively connecting portions of the edges of the first and second and second and third segments in a manner such that at least the front surfaces of the segments are in a common plane when the segment-connector means are not flexed, whereby the front surfaces of the segments may be printed in one-sided printing operation, and for juxtaposing the front surfaces of the first and second segments when the segment-connector means between these segments is flexed, and for juxtaposing one of the surfaces of the third segment with a back surface of one of the first and second segments when the segment-connector means between the second and third segments is flexed;

attaching means for attaching at least one of the segments to an item; and closing means for holding the segment-connector means flexed until it is desired to unflex at least one, whereby to expose the printing on the front surface of at least one of the segments, the improvement wherein:

the closing means comprises adhesive (56, 56') on the back surfaces of each of the segments;

the attaching means comprises a tail strap (54, 54') axially projecting from an end on an edge of one of the segments (50, 50') opposite the other segments (10*c*, 12*c*, 14*c*; 10*c'*, 12*c'*, 14*c'*) to an opposite, free end for flexing to loop through an object;

the segment-connector means each comprise fold lines (22*c*, 24*c*, 49; 22*c'*, 24*c'*, 49') between edges of the segments; and the segments additionally comprise a fourth segment (10*c*, 10*c'*), the first, second and third segments (50, 14*c*, 12*c*; 50', 14*c'*, 12*c'*) being congruent and in line with each other and the tail strap, and the fourth segment being in line with the other segments opposite the tail strap and only similar to the other segments in being axially shorter than the other segments.

2. The tag of claim 1, assembled for use with the segment-connector means and tail strap flexed for superposing all the segments, wherein the front surfaces of the third and fourth segments (10*c'*, 12*c'*) are juxtaposed and the free end of the tail strap is between the first and fourth segments (50', 10*c'*).

3. In a tag having:

at least first, second and third planar segments, each segment having opposite, front and back planar surfaces bounded by at least one edge extending between the planar surfaces, the front surfaces being for printing;

at least two, flexible, segment-connector means for respectively connecting portions of the edges of the first and second and second and third segments in a manner such that at least the front surfaces of the segments are in a common plane when the segment-connector means are not flexed, whereby the front surfaces of the segments may be printed in one-sided printing operation, and for juxtaposing the front surfaces of the first and second segments when the segment-connector means between these segments is flexed, and for juxtaposing one of the surfaces of the third segment with a back surface of one of the first and second segments when the segment-connector means between the second and third segments is flexed;

attaching means for attaching at least one of the segments to an item; and closing means for holding the segment-connector means flexed until it is desired to unflex at least one, whereby to expose the printing on the front surface of at least one of the segments, the improvement wherein:

the closing means comprises adhesive (64) on the back surfaces of each of the segments (10*e*, 12, 14*e*, 36*e*);

the attaching means comprises a strap (34*e*) axially extending between opposite ends on edges of two of the segments (12*e*, 14*e*) for flexing to loop through an object;

the segment-connector means comprise the strap (34*e*) and the two fold lines (60, 62); and the segments additionally comprise a fourth segment (10*e*), the first and second segments (36*e*, 14*e*) being connected to each other by one of the fold lines (62) successively and axially of the strap with the second segment (14*e*) having the edge on one end of the strap, and the third and fourth segments (12*e*, 14*e*) being connected to each other by the other of the fold lines (60) successively and axially of the strap with the third segment (12*e*) having the edge on the opposite end of the strap, the first, second and third segments (36*e*, 14*e*, 12*e*) being congruent, and the fourth segment (10*e*) being only similar to the other segments in being axially shorter than the other segments.

4. The tag of claim 3, assembled for use with the segment-connector means and strap thereof flexed for superposing all the segments, wherein the front surfaces of the third and fourth segments (12*e*, 10*e*) are centrally juxtaposed and the back surfaces of the later are juxtaposed respectively with the back surfaces of the second and first segments (14*e*, 36*e*), respectively.

5. In a tag having:

at least first (20, 68) second (18, 72) and third (16, 70) planar segments, each segment having opposite, front and back planar surfaces bounded by at least one edge extending between the planar surfaces, the front being for printing;

at least two, flexible, segment-connector means for respectively connecting portions of the edges of the first and second (24, 74) and second and third (22, 76) segments in a manner such that at least the front surfaces of the segments are in a common plane when the segment-connector means are not flexed, whereby the front surfaces of the segments may be printed in one-sided printing operation, and for juxtaposing the front surfaces of the first and second segments when the segment-connector means (24, 74) between these segments is flexed, and for juxtaposing one of the surfaces of the third segment (16, 70) with a back surface of one of the first and second (18, 72) segments when the segment-connector means (22, 76) between the second and third segments is flexed;

attaching means for attaching at least one of the segments to an item; and closing means for holding the segment-connector means flexed until it is desired to unflex at least one, whereby to expose the printing on the front surface of at least one of the segments, the improvement wherein:

the back surface of the second segment (18, 72) is juxtaposed with the back surface of the third segment (16, 70), and portions of the back surface of the third segment (16,70) are not covered by the second segment (18, 72) when the two are juxtaposed by the flexing of the segment connector means (22, 76) between them;

the segment-connector means each comprise fold lines, one of the fold (24, 74) being on a first edge of the second segment (18, 72) and a corresponding edge of the first segment (20, 68), and the other of the fold lines (22, 76) being on a second, not necessarily adjacent edge of the second segment (18, 72) and a corresponding edge of the third segment (16, 70);

the attaching means comprises adhesives on the back surface of the first segment; and the closing means comprises adhesives on the back surface of the third segment.

6. The tag of claim 5, wherein the one of the fold lines is flexed to juxtapose the front surfaces of the first and second segments, and the other of the fold lines is flexed to superpose the back surfaces of the second and third segments.

* * * * *